US006878064B2

(12) United States Patent
Huang

(10) Patent No.: US 6,878,064 B2
(45) **Date of Patent: *Apr. 12, 2005**

(54) VIDEO AND REEL CARD GAME

(76) Inventor: Sming Huang, 45 Stouts La., Suite 8, Monmouth Junction, NJ (US) 08852

( * ) Notice: Subject to any disclaimer, the term of this patent is extended or adjusted under 35 U.S.C. 154(b) by 0 days.

This patent is subject to a terminal disclaimer.

(21) Appl. No.: 10/610,802

(22) Filed: Jul. 1, 2003

(65) Prior Publication Data

US 2004/0009800 A1 Jan. 15, 2004

Related U.S. Application Data

(63) Continuation-in-part of application No. 09/900,789, filed on Jul. 6, 2001, now abandoned.

(51) Int. Cl.[7] ..... A63F 9/24
(52) U.S. Cl. ..... 463/30; 463/16
(58) Field of Search ..... 463/12–13, 16, 463/37, 20–22, 30–31; 273/143 R, 138.1, 139

(56) References Cited

U.S. PATENT DOCUMENTS

| | | | | | |
|---|---|---|---|---|---|
| 4,095,795 | A | | 6/1978 | Saxton et al. | |
| 4,448,419 | A | | 5/1984 | Telnaes | |
| 4,657,256 | A | | 4/1987 | Okada | |
| 4,700,948 | A | | 10/1987 | Okada | |
| 5,188,363 | A | * | 2/1993 | Marnell et al. | 463/13 |
| 5,591,081 | A | | 1/1997 | Suzuki | |
| 5,820,460 | A | * | 10/1998 | Fulton | 463/13 |
| 5,934,998 | A | | 8/1999 | Forte et al. | |
| 5,938,529 | A | | 8/1999 | Rodesch et al. | |
| 6,105,962 | A | | 8/2000 | Malavazos et al. | |
| 6,159,095 | A | * | 12/2000 | Frohm et al. | 463/19 |
| 6,176,781 | B1 | | 1/2001 | Walker et al. | |
| 6,302,790 | B1 | | 10/2001 | Brossard | |
| 2003/0008699 | A1 | * | 1/2003 | Huang | 463/16 |

* cited by examiner

*Primary Examiner*—Kim Nguyen
(74) *Attorney, Agent, or Firm*—Perry Hoffman

(57) ABSTRACT

An amusement apparatus in association with a video program and a computer for various mechanical controls that are player-operable and responsive for card value and suit generation during the course of a card game. The method for playing a card game controlled by a processor includes a first region with a visual display on a card game machine for displaying a plurality of cards. There is a second region with a visual display on the card game machine for presenting a card selection display of card value and suit indicia. The game operates with the processor to draw cards that appear in the first region. Card selection input is received through the second region for display on the first region of the visual display. There is a player control interface for user selection input that effects the selection of cards at the second region.

21 Claims, 15 Drawing Sheets

70

78
Speaker
104
106
108
102
110
STAY
HIT
START
BET
PAY
STOP
DOUBLE
SPLIT
I/O Board
112
114
116
118
84
88
86
Video Controller
First Visual Display Region
120
72
Microprocessor
ROM
74
RAM
76
94
92
Video Controller
OR
98
96
Reels Controller
100
Second Visual Display Region
90
82
Pay out or Cash-less Printer
80
Bill Acceptor, Coin In, Credit Card or Cash-less Reader When the wheels stop spinning, the values shown from the blue peeking window is the newly drawn card value. In this figure, it is "Spade 9".

Air-Driven Balls In A Spinning Drum

This is like a Lotto drawing machine. Randomness is achieved by the force of the compressed air and the spinning drum.

Implementation Example For Blackjack

- Use fifty two balls to represent all fifty two cards' values.

VIDEO AND REEL CARD GAME

CROSS-REFERENCE TO RELATED APPLICATIONS

This application is a continuation-in-part of U.S. patent application Ser. No. 09/900,789 filed 6, Jul. 2001, now abandoned.

FIELD OF THE INVENTION

The present invention relates to a video card game amusement apparatus in combination with a reel card game feature. More particularly, there is provided an amusement apparatus in association with a video program and a computer for various mechanical controls that are player-operable and responsive for card value and suit generation during the course of a card game.

BACKGROUND OF THE INVENTION

Reel-type slot machines are well known and have been employed in both conventional slot machine games as well as card games. The traditional slot machine has a series of annular reels disposed in a side-by-side relationship that rotate separately about a common axis. Players' scores or winnings are shown by indicia on the peripheral surfaces of the reels that may align in any number of different combinations following a period of rotation of the reels. Players of gaming apparatus typically find it enjoyable to have a variety of different forms of amusement apparatus available. For this purpose, slot machines of the spinning reel type have been provided with a variety of different graphics, cabinet configurations and other varied embellishments such as varying visual or sound effects and differing scoring systems. Modifications of slot machines of this kind to enhance player enjoyment are circumscribed if the above-described basic geometry of mechanical components of the apparatus is retained. The side-by-side reel arrangement has in the past imparted an undesirable degree of similarity to slot machines of this type notwithstanding the superficial variations of the above-described kind.

With the advent of computer technology, electronic slot machines were designed. Initially, the electronic slot machines did not employ reels. Rather, these machines utilized a video screen display to simulate a reel. These machines were of limited commercial success. Eventually, electronic-type reel machines were developed. These machines removed the game from the reels and played the game in a microprocessor. The reels became simply a method of displaying the results of the game. Such a machine is taught in U.S. Pat. No. 4,095,795 to Saxton, et al. for "Amusement apparatus and method" issued 20 Jun. 1978. In these machines "virtual reels" are represented by random-number generators in a microprocessor. The random-number generators produce a number and that number corresponds to a reel position on the physical reel. In other words, the numbers of the random number generators are mapped to the physical reel positions. Initially, these virtual reel machines generated one number for each position on the reel. Thus, there was a direct mapping and the odds were not changed. Subsequently, the concept of many to one mapping was introduced and it allowed the odds associated with virtual reel machines to be adjusted See, e.g., U.S. Pat. No. 4,448,419 to Telnaes for "Electronic gaming device utilizing a random number generator for selecting the reel stop positions" issued 15 May 1984. These machines use random number generators to generate numbers from a range of numbers that exceeds the number of physical reel combinations. These numbers are mapped to certain reel combinations with multiple numbers being mapped to some combinations. In this manner, the odds of displaying some combinations will exceed the odds of displaying other combinations thereby allowing for higher payout odds. However, this concept was not used for card games.

In operation, the virtual reel slot machines generate a number with a random number generator. That number is then put into a lookup table to ascertain the appropriate display and pay-out. This whole procedure is independent of the physical reels.

The use of only computer-controlled reel type card games and computer controlled video card games has resulted in a loss of confidence by the player as to his ability to affect the results of the game. The card amusement game player has come to believe that the game of chance no longer exists and that the outcome and pay-out is all controlled by the house, which has programmed the computer to the number and degree of pay-outs.

U.S. Pat. No. 5,938,529 to Rodesch et al. for "Reel type slot machine having stepper motor monitoring system" filed 17 Aug. 1999, which is herewith incorporated by reference, discloses a reel type slot machine having a microprocessor driven game control circuit including a reel driven by a stepper motor that could be used in the present invention.

U.S. Pat. No. 6,105,962 to Malavazos et al. for "Rotating disks slot machine" issued 22 Aug. 2000, which is herein incorporated by reference, discloses an amusement apparatus that contains two separate games. One game is a conventional reel game and the other game has a plurality of rotatable disks having indicia that are spaced apart and encircle the disks and provide a score when the indicia rest at any of a plurality of angular orientations.

It is therefore proposed to provide a card game amusement apparatus in which the player can interact with visual or mechanical controls that are responsive in relation to a degree of player operation for card value and suit generation during the course of a given card game.

SUMMARY OF THE INVENTION

In accordance with the invention, there is provided a card game amusement apparatus having a reel device displaying card indicia and a video card display. Accordingly, the video card game device displays cards in a first region on the apparatus and the reel device displays cards on a second region of the apparatus. The card displays in the first region are associated with a microprocessor that controls the starting and stopping of the device and controls the probability of the card value and suit on stoppage.

Preferably, the card machine game is similar to the game of blackjack, and one display region represents the initial hand of the dealer; another display region shows additional cards and the player.

The game machine allows the operator to provide blackjack games with automatic small footprint machines. The game operator does not have to pay for card dealers. The game operator can also save cost on chips management. Some blackjack players prefer to play alone. They do not want other players' hits to affect the probability of drawing a certain card. The blackjack player on a human-operated dealer table does not have the flexibility to refuse to allow other players to play on the same table.

In a single hand card game in which different hands have a win, such as in draw poker, the additional cards are selected by the luck of the player. The card game machine may be used with single or multiple players as in a blackjack game. A first hand displayed is generated by a microprocessor. Advantageously, there is provided an amusement apparatus in association with a video program and a computer for various visual or mechanical controls that are player-operable and responsive for card value and suit generation during the course of a card game. Thus, the players can affect or appear to affect the probability of the cards displayed. To this end, the players' card selection may be provided from mechanical apparatus. A card game machine designed having such a second visual display region that can be seen and understood by the player. The player's trust to the fairness of the machine will be greatly enhanced. The player is no longer dealing with a microprocessor that executes complicated random generation programs in a sealed black box. Instead, the player can see the card selection process executed in a familiar mechanical random generator like spinning reels, spinning wheels or chase lights. The extra few seconds spent by the mechanical random generator will prolong the player's excitement. The game machine also combines the entertaining elements of two popular games, blackjack and slot machines.

A machine and method provide a novel way of playing various card games. The method for playing a card game controlled by a processor comprises a first region with a visual display on a card game machine for displaying a plurality of cards. There is a second region with a visual display on the card game machine for presenting a card selection display of card value and suit indicia. The game operates with the processor to draw cards that appear in the first region. Card selection input is received through the second region for display on the first region of the visual display. There is a player control interface for user selection input that effects the selection of cards at the second region.

The objects and advantages of the invention will be better understood in the drawings and preferred embodiments that follow.

DESCRIPTION OF THE PREFERRED EMBODIMENTS

Figure 1:
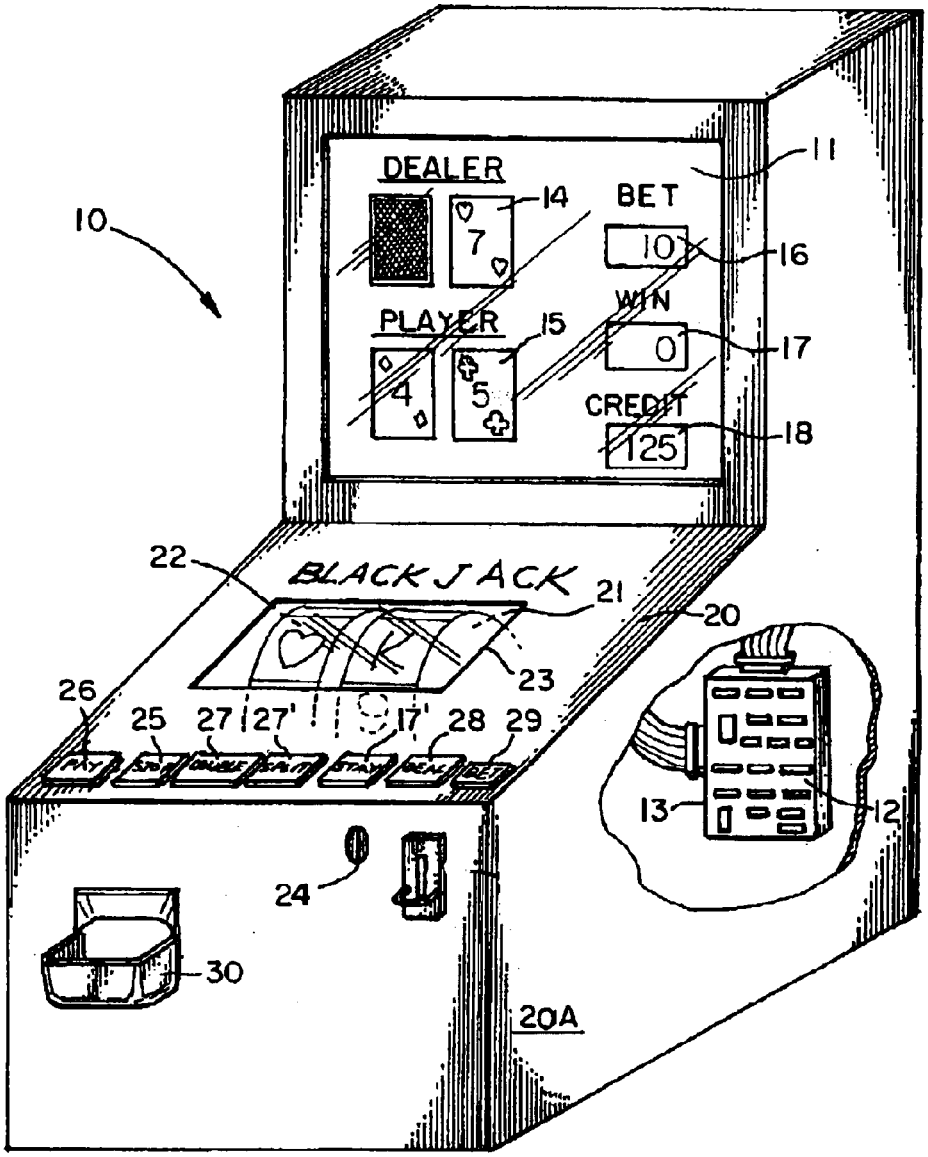
FIG. 1 illustrates a card game machine for playing a card game.

According to one embodiment of the invention there is provided a card game apparatus 10 that can be employed for the playing of a card game such as blackjack. The apparatus contains a first region 11, which contains a memory device 12, in which every processing program is stored and a computer 13 for controlling operations of the processing programs.

The method for playing a card game controlled by a processor includes a first region with a visual display on a card game machine for displaying a plurality of cards. The first region 11 contains a two-card video display 14 for a dealer in the game of blackjack and a two-card video display 15 for a player. The card displays 14, 15 are controlled by programs in the computer. On the first region 11 there may be provided additional displays that are controlled by the microprocessor 13, e.g., a bet display 16 to show amount won and a credit display 18 to show total amount of credits won.

There is a second region with a visual display on the card game machine for presenting a card selection display of card value and suit indicia. The game operates with the processor to draw cards that appear in the first region. Card selection input is received through the second region for display on the first region of the visual display. In a second display region 20 there is provided a display of mechanically-driven reels 21, 22 having an annular band of card indicia of a card value and suit, which are indicated in the display area 23. There is a player control interface for user selection input that effects the selection of cards at the second region. There may be included a start button 24, which initiates the game at regions 11, 20. The apparatus 10 has a stop button 25 that is used by the player to control the reel game. Preferably, the player uses the button 25 to control the stoppage of the reels 21, 22. The user selection input may also be provided as a video touch screen. As discussed herein, various mechanisms may be used to give players the impression that operations are random. If the reels 21, 22 are not controlled by a microprocessor, the player will believe that he has control of the chance of a particular card's appearing.

Within the apparatus a conventional game control apparatus is provided in a microprocessor 13 for controlling the game apparatus for the video display to cause video reels 21 and 22 to stop at predetermined stopping positions. Game control circuits, which normally include a microprocessor and associated memory input and output circuits, receive signals from a coin input detector (not shown) and the microprocessor 13 selects a game result which requires video reels 21 and 22 to stop at a predetermined area which will display the results. Such display can be either for the dealer or the player. The microprocessor 13 utilizes a stored random number generating algorithm, selects a game result that requires stoppage of the video reels 21, 22 at predetermined stopping positions that will be displayed at region 11. The cards can be either the dealer's hand or the player's hand whereby the outcome of the game will be determined by the player of reels 21 and 22.

Indicia are imprinted on the visible regions of each reel 20, 21 and are arranged in. annular bands, which are centered on the axis of rotation. The indicia of each reel 20, 21 can represent suit and value as shown or both suit and value. As in other slot machines, a player or dealer's score is determined by the particular indicia that come to rest or in alignment in the display region 14, as determined.

The reels are housed in a cabinet 20A behind a transparent window not shown. The cabinet of region 20 can be provided with various play buttons, which are associated in a game such as blackjack. For example, button 26 is the pay-out button; 27' and 27" represent the plays of double-up's, split, and stay respectively in blackjack; buttons 28 and 29 can represent "stay" and "deal".

Usually, the upper region 11 would also have a bet display 16, a win display 17, and a credit display 18, all associated with the microprocessor 13.

Accordingly, there is provided a card game apparatus that includes one or more reels that are associated with a mechanism that physically controls the odds of the reel stopping at any particular reel position in such a manner that the probability of stopping one reel position differs from the probability of stopping at least one other reel position.

Slot machine motor control circuits, which are microprocessor controlled, require tracking of the rotary movement of the indicia-carrying member by the microprocessor. In a known manner such as described in U.S. Pat. No. 6,105,962, discussed above, tracking means may be provided to cause the stopping of rotation of the reels when the indicia are aligned to determine card suit and value. The apparatus 10 is provided with a start button 24, which activates card generation using the computer. After the card generation, then the button 25 starts the rotation of reels 21 and 22. Button 25 can be used to stop rotation of the reels. In this case, either one of the reels can be free spinning or can operate from gears of stator motors of different diameters so that one reel travels faster than the other reel. In such cases, it is the luck of the player that determines the outcome of the reels.

Figure 2:
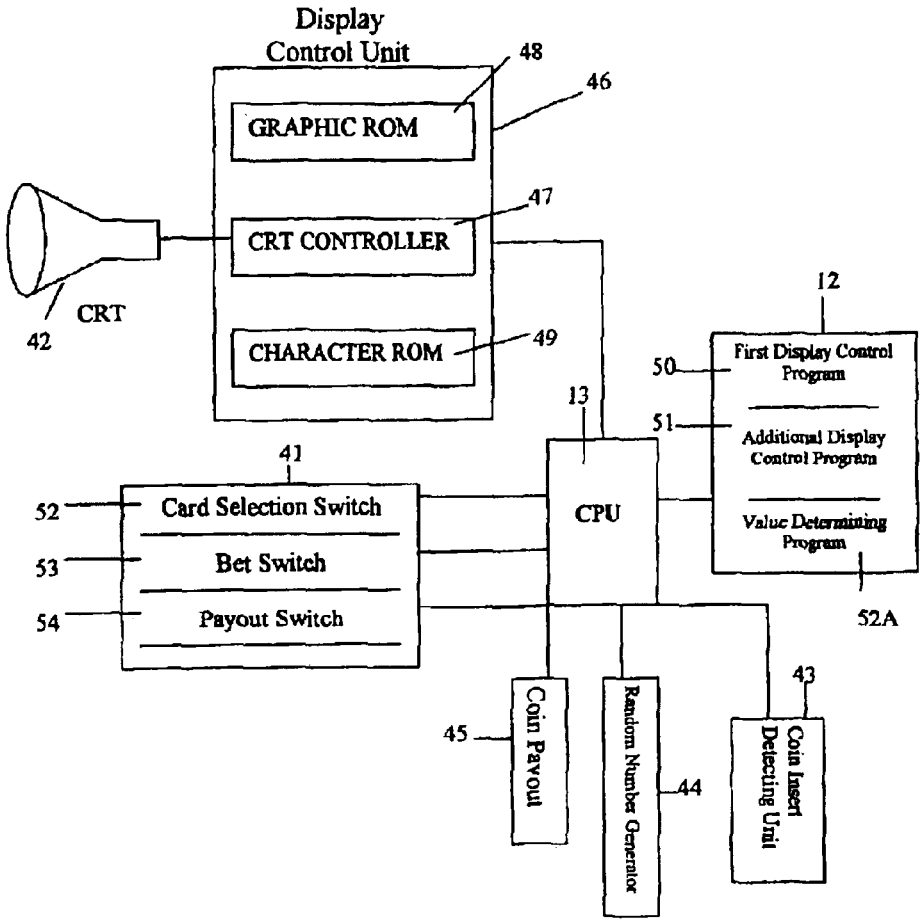
FIG. 2 illustrates a block diagram showing a configuration of the card game machine.

FIG. 2 is a block diagram showing a configuration of a card game amusement device of the invention. The card game amusement device comprises a memory device 12 in which every processing program is stored, a CPU 13 for controlling operations of the processing programs, and a control panel 41 with every switch arranged. The card game amusement device further comprises a CRT 42, a coin insert detection unit 43 for detecting the insertion of a coin, a random number generator 44 for generating a random number, a coin pay-out unit 45 for paying out coins, and a reset unit for resetting the reels and an audio unit.

The display control unit 46 comprises a CRT controller 47 for controlling the display images to the CRT 42, a graphic RAM unit 48 for temporarily storing graphic data to be sent into the CRT 42, and a character ROM 49 in which character data are stored.

The memory device 12 contains a first display control program 50 that displays the cards on the video display. An additional display control program 51 is provided for additional card plays. There is also a value-determining program 52A for determining whether the plural cards displayed determine a winning hand.

The control panel 41 comprises a card selection switch 52 for selecting one or more cards to be displayed on the video display, a switch 53 for entering a bet and a switch 54 for requesting a payment of coins.

Accordingly, when a coin is inserted through the coin slot, the coin-detecting unit 43 detects the fact of the insertion and the number of coins inserted and transmits to the CPU 13.

Figure 3:
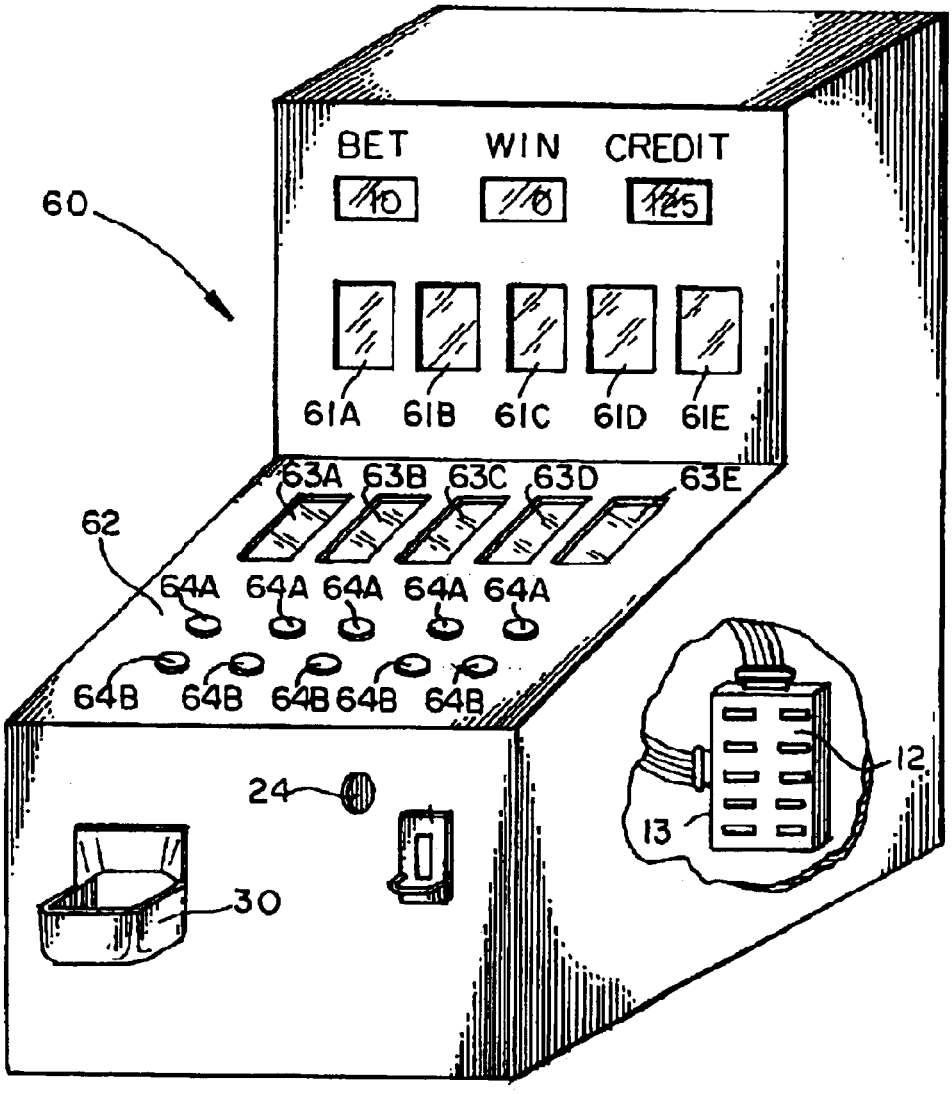
FIG. 3 illustrates an alternate embodiment card game machine for playing a card game, including five cards.

As illustrated in FIG. 3, a card game apparatus 60 may be provided so as to play a. card game with five cards, e.g., draw poker. The apparatus 60 is provided with a video display 61A, 61B, 61C, 61D, and 61E of five cards that are selected from a program of a memory device 12.

At another region 62 of the apparatus 60 are five reels, which are adapted to display five cards at displays 63A, 63B, 63C, 63D, and 63E. Each reel at the display is associated with a "draw" button 64A and a "hold" button 64B.

Cards are shown at the video displays 61A, 61B, 61C, 61D, and 61E and are selected from a program of memory 12. The player can then select which of the cards are to be changed by pressing one of the "draw" buttons 64A associated with a reel and/or one of the "hold" buttons 64B so that the player can "stand" or "draw" one or more cards. The player will register a win if the hand he receives is, for example, a pair of jacks or better. More credit will be given as the hand gets higher, for example, three of a kind, straight, or better.

Figure 4A:
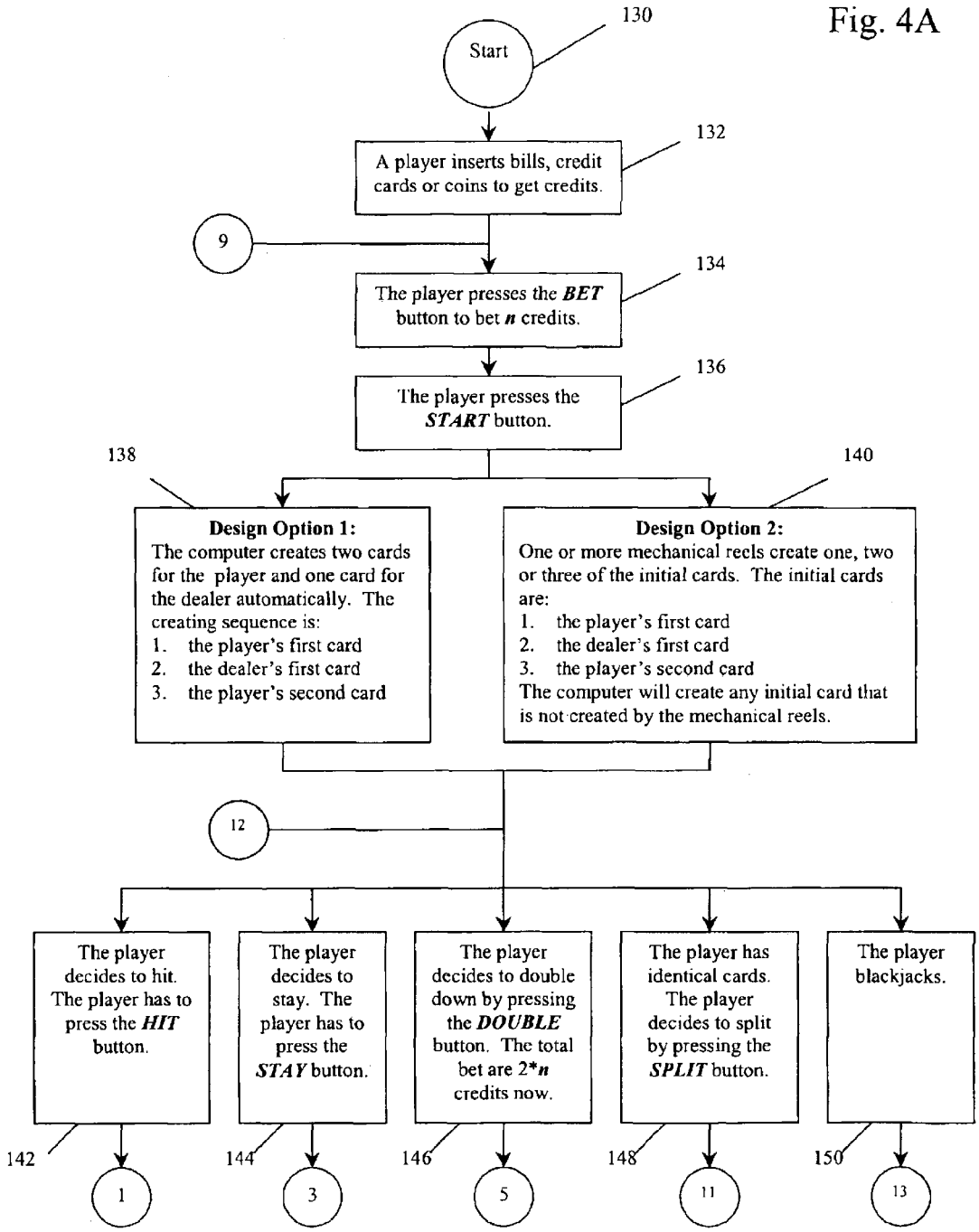
FIGS. 4A–4G are program flow diagrams illustrating an example of a blackjack game using video or mechanical reels in connection with the game play.
Figure 4B:
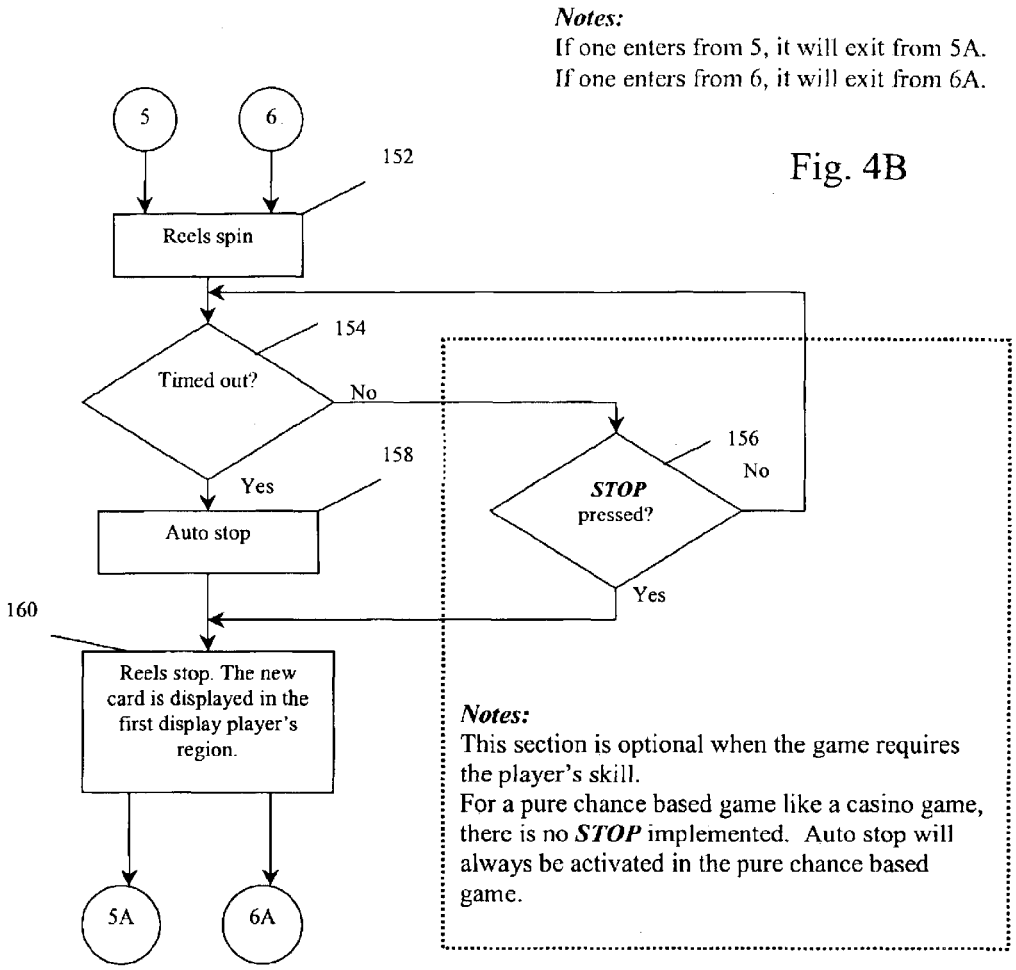
Figure 4C:
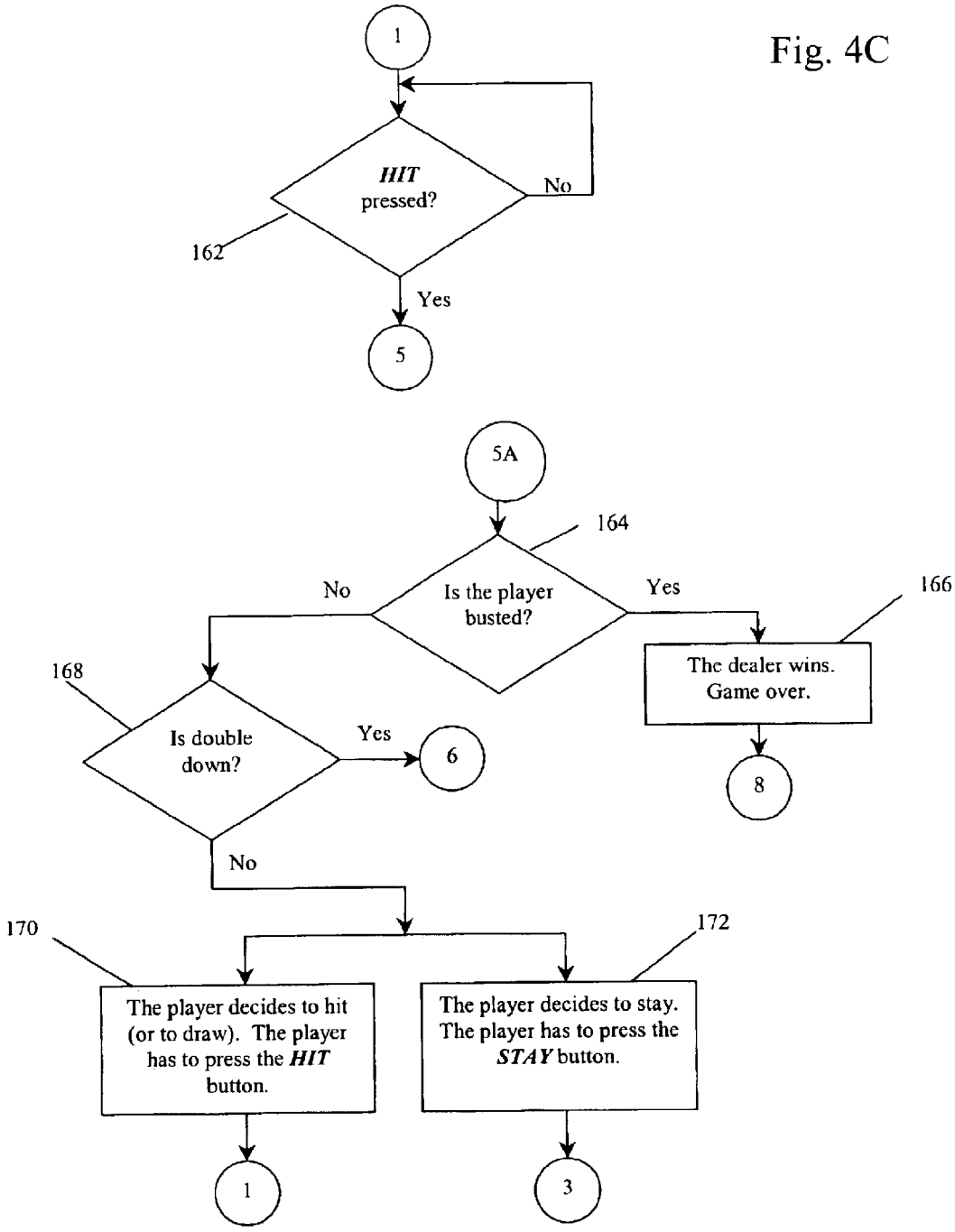
Figure 4D:
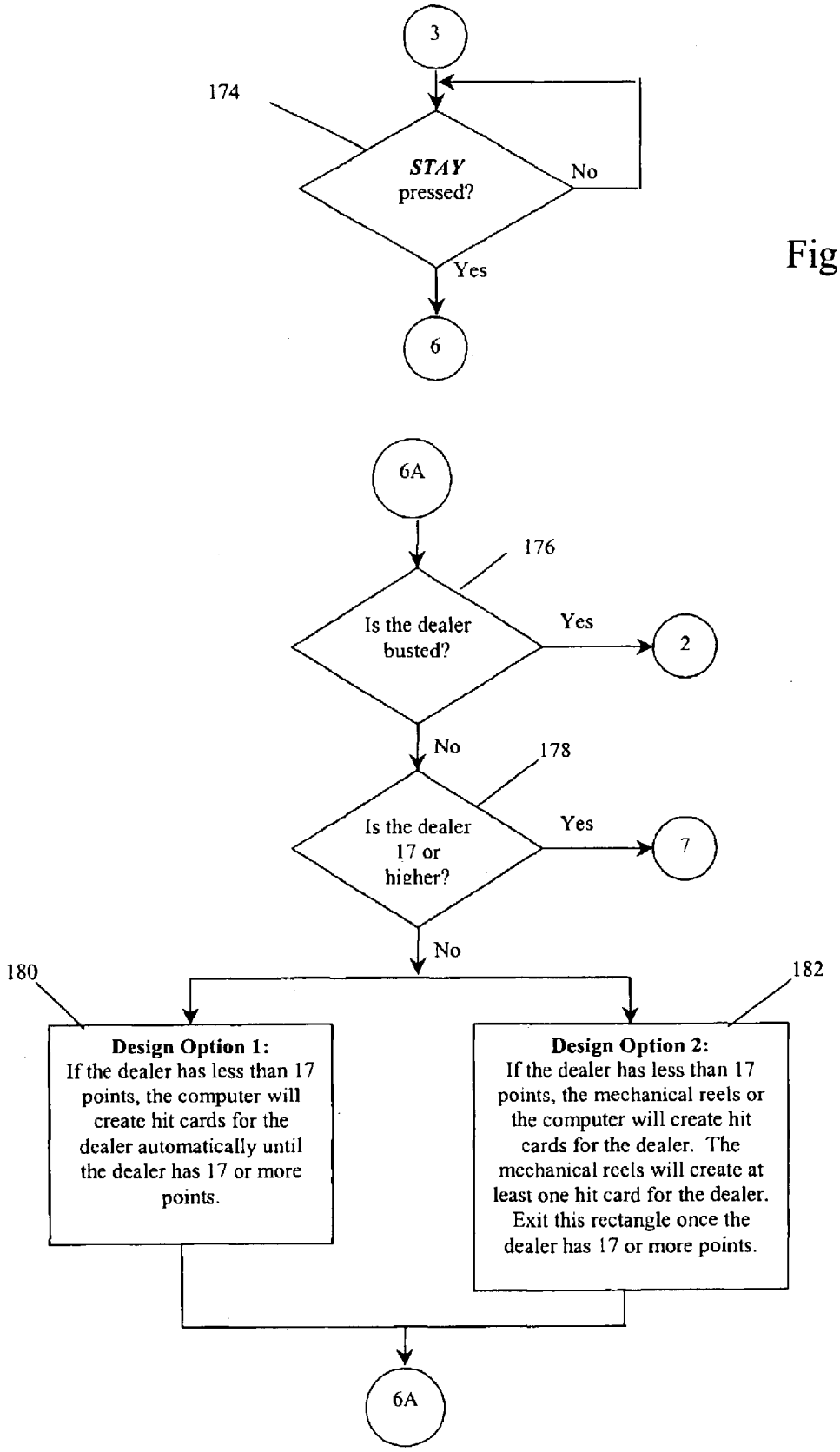
Figure 4E:
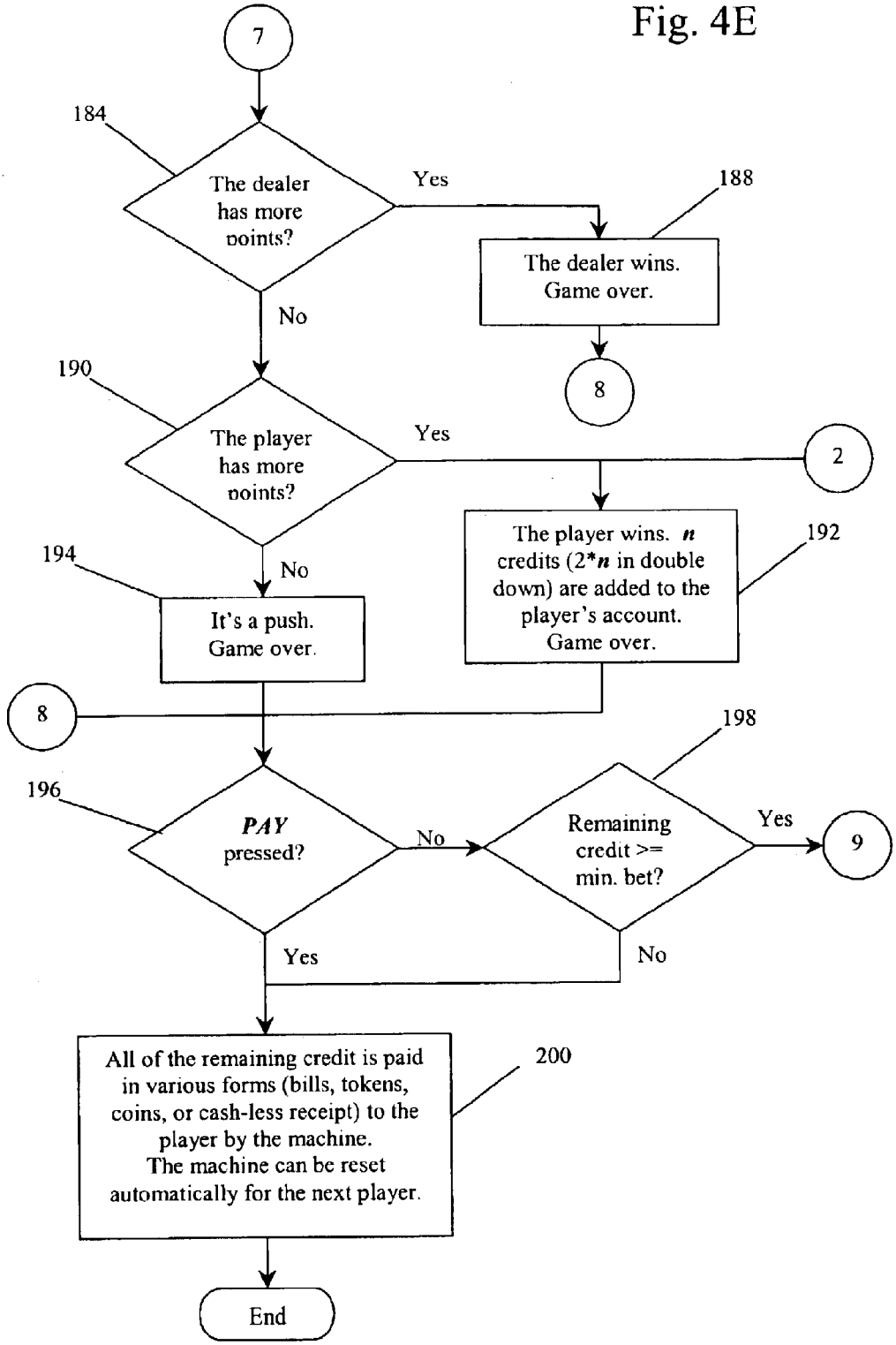
Figure 4F:
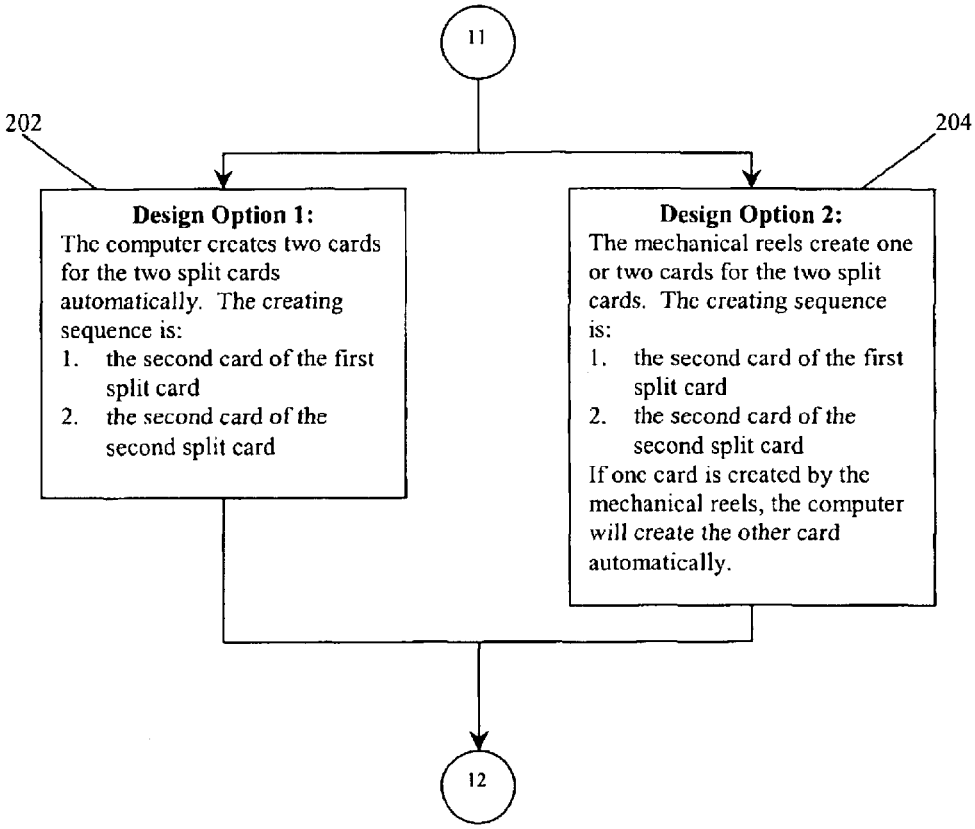
Figure 4G:
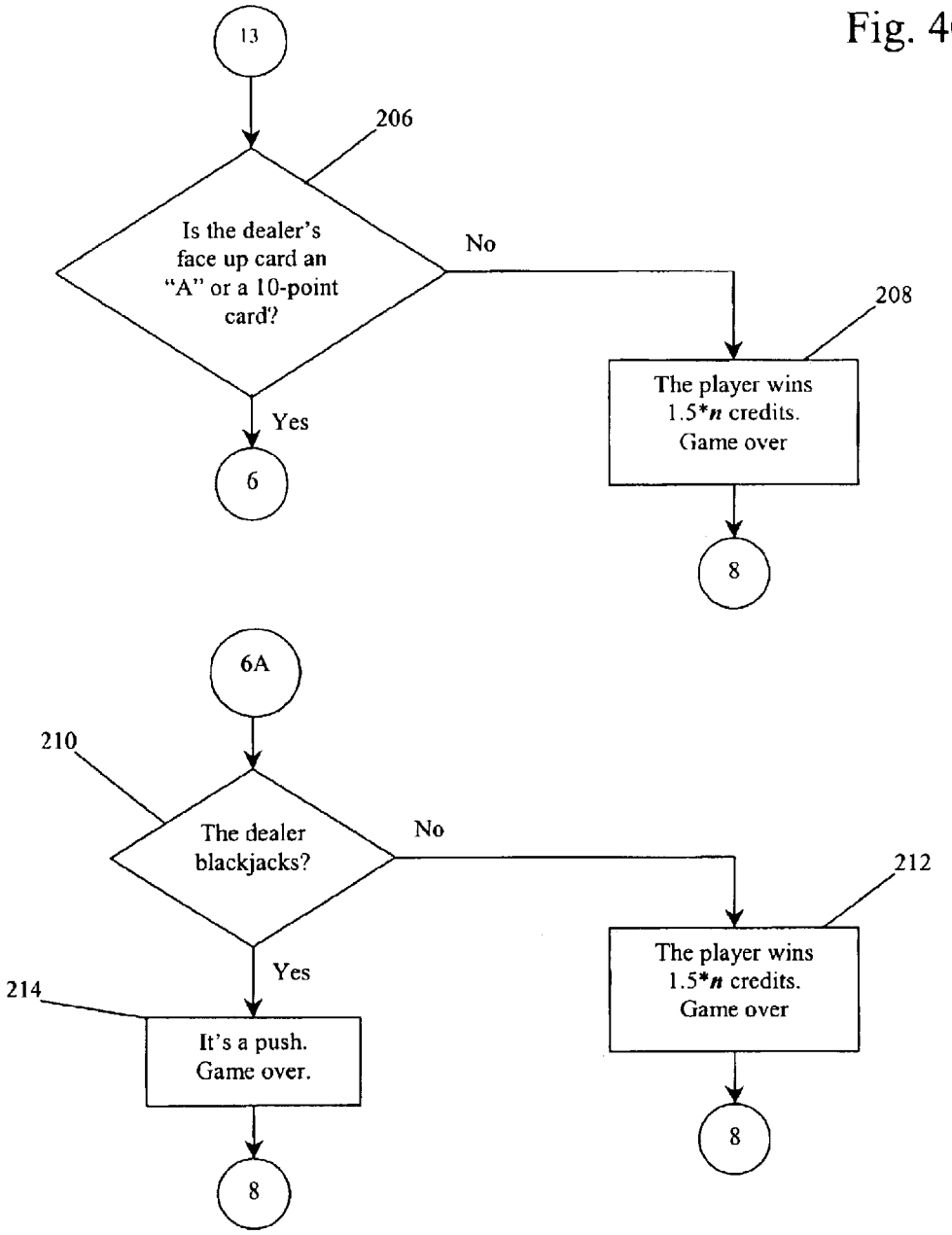
Figure 5:
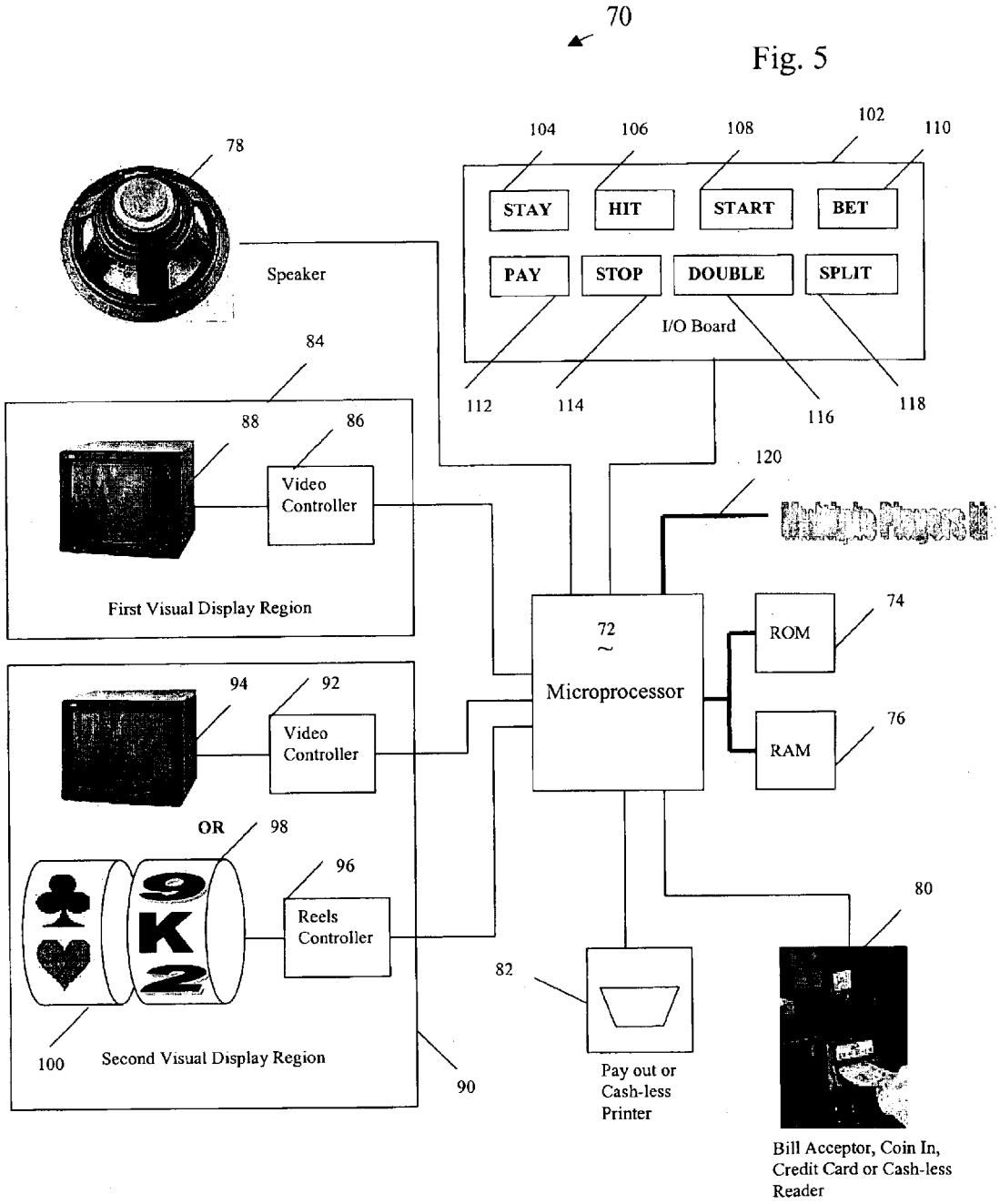
FIG. 5 shows a functional block diagram illustrating the hardware design of the games.

With reference to the game-playing flowchart of FIGS. 4A–4G and the functional block diagram of FIG. 5, the alternate embodiment presently described relates to card generation mechanisms for the card game machine 70, shown generally in FIG. 5. This embodiment is operable under control of a microprocessor 72 with associated ROM 74 and RAM 76 with further interface with a speaker 78, a coin/currency acceptor or like payment receipt devices 80, and a pay-out or cash-less printer 82. A first visual display region 84 may include a video controller 86 and a video display unit 88, as illustrated. Additionally, a second visual display region 90 is illustrated as interfaced with the microprocessor 72, providing other video output that is controlled by microprocessor using a video controller 92 and a video display unit 94, or mechanical input such as that provided with rotating mechanical reels using, e.g., a reel controller 96 interfaced with the mechanical reels 98 and 100, as illustrated. Additionally, the microprocessor 72 provides a link to multiple players allowing for multiple hands in a game environment having multiple players through an interface between microprocessors, e.g., microprocessor 72.

Significantly, an input/output board 102 is interfaced with the microprocessor 72 allowing player control for affecting card play and the second visual display region and means responsive to player control for generating card value and suit for display in the second visual display region. The player control 102 includes several inputs including: a stay button 104; hit 106; start 108; bet 110; pay 112; stop 114; double 116; and split 118 discussed further below in connection with the example of blackjack games using the game-playing flowchart. The multiple player link with the microprocessor 72 is illustrated at 120.

Turning now to the example of the blackjack games using video or mechanical reels as illustrated in the game-playing flowchart of FIGS. 4A–4G, the card-generation mechanisms are provided as discussed below.

The player starts the card generation process by pressing the hit button 106. The reels in the second display region will start spinning. The player can either press the stop button 119 or let the reels stop automatically. At this time, the card generation process may produce a face-down card (e.g., the dealer's second card in a blackjack game) upon which event the second display region has to be blocked from the view of the player.

The following sections describe how the card generation function in the second visual display region affects the operation in the first visual display region. There are three different mechanisms used to decide the value of the new card to be drawn, including: 1.) microprocessor controlled, pre-arranged; 2.) microprocessor controlled, random; 3.) mechanically-controlled, random. The reels in the second display can be either mechanical or video. The "mechanically-controlled, random" mechanism will require a mechanical reel as the random generator.

The microprocessor may provide pre-arranged control over the value of the next drawn card and controls the first visual display region accordingly. The reels in the second visual display only show the result decided by the microprocessor after spinning. This form of display is like the "shoe" game of casino table blackjack. A total of one or more decks of cards are shuffled and pre-arranged by the microprocessor when the player starts the game. A card that is drawn will be removed from the available drawing pool until the whole deck is reshuffled. Reshuffling will occur when the game is reset or when the available drawing pool has been depleted to the customary level at which reshuffling takes place at a casino blackjack table. The odds of drawing a certain card value depend on the cards already drawn since last shuffling.

The microprocessor may provide randomized control over the value of the next drawn card and controls the first visual display region accordingly. The reels in the second visual display only display the result decided by the microprocessor after spinning. The odds of drawing a certain card value may or may not depend on the cards already drawn.

The random mechanical reels in the second visual display provide a mechanical random output of the value of the next drawn card. The microprocessor will receive inputs from the mechanical reels and controls the first visual display region accordingly. The result is like reshuffling a complete deck of cards before each new card is drawn. The odds of a certain card value is independent to the cards already drawn.

In accordance with the game-playing flowchart, the player start is initiated at 130, wherein at 132 the player provides money for game playing credits and the player presses the bet button 110 at 134 to bet a determined number of credits. The current player then presses the start button 108 at 136 and game play proceeds either to design option 1 at 138 or design option 2 at 140, as shown in FIG. 4A in which the microprocessor 72 provides a dealing sequence as between the player and dealer using video and/or mechanical display mechanisms. At 138 the dealer's second card selection is performed using spinning reels in order to ensure that a minimum of one card is selected by the reels during the course of every game. On the other hand, at 140 the initial card is not selected by way of mechanical reels.

The game play proceeds with player selection as indicated by options 142, 144, 146, 148 or 150, which provide player input through respective hit 160, stay 104, double 116 and split 118 inputs via the input/output board 102. At 150, however, the player blackjacks.

Wheels spin at 152 for the selection of additional card determinations. A timeout is determined at 154 either by way of a stop at 156 using the stop button 114 or through the use of an auto stop at 158. The wheels stop at 160 and the new card is displayed in the first display region for the player's hand.

Proceeding from step 142 where the player decides to hit, the determination that the hit button 106 is depressed is determined at 162 from which the wheels spin at 154 for the player card selection as discussed above in connection with FIG. 4B. With reference to FIG. 4C, the player card selection output of step 160 may proceed to step 164 where determination is made as to whether the player is busted. When the player is busted, the dealer wins and the game is over at 166. Where the player is not busted, a double-down is determined at 168 and the player may decide to hit at 170 or stay at 172.

With reference to FIG. 4D where stay is pressed at 174, wheels spin at 152 as discussed in connection with FIG. 4B above. On the other hand, the determination at 176 determines whether the dealer is busted and whether the dealer has 17 or higher at 178. Design options 1 and 2 are shown at 180 and 182, respectively. In accordance with the first design option 180, if the dealer has less than 17 points, the computer will create hit cards for the dealer automatically until the dealer has 17 or more points. On the other hand, in accordance with the second design option 182, if the dealer has less than 17 points, the mechanical wheels may be used to create additional hit cards for the dealer. Accordingly, the second design option again provides for operation of at least one card being drawn via the mechanical selection mechanism.

With reference to FIG. 4E, step 184 determines whether the dealer has more points than the player; if so, the dealer wins and the game is over at 188. Where the player has more points at 190, a determination is made as to whether the player wins at 192 or a push is determined and the game is over at 194. At 196 a determination is made if the pay button 112 is pressed. Step 198 determines remaining credit and step 200 provides for pay-out and reset of the card game machine 70.

Regarding the first and second design options as discussed above for use in connection with at least one card's being created by mechanical wheels or the like, FIG. 4F shows the first design option 202 and the second design option 204 in connection with the selection of split cards being automatically generated on player selection. In FIG. 4G, the dealer's card display is provided at 206 to determine if the dealer's face-up card is an ace or a 10-point card. The player's win determination is made at step 208. The dealer's blackjack is determined at step 10, from which either player win 212 or push 214 is identified for blackjacks by both the player and dealer, after which the game is over.

Figure 6A:
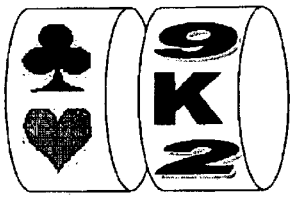
FIGS. 6A–6D illustrate various mechanically-controlled, random card-selection mechanisms.
Figure 6B:
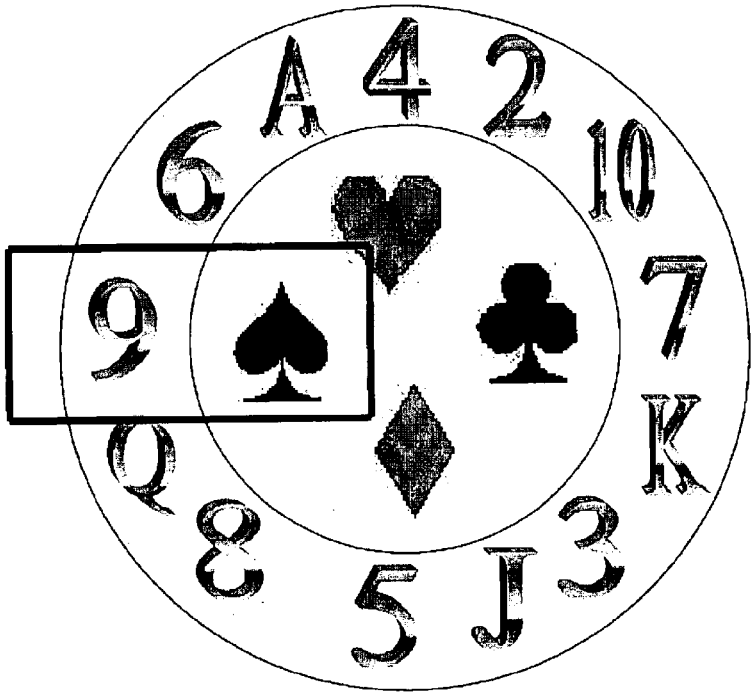
Figure 6C:
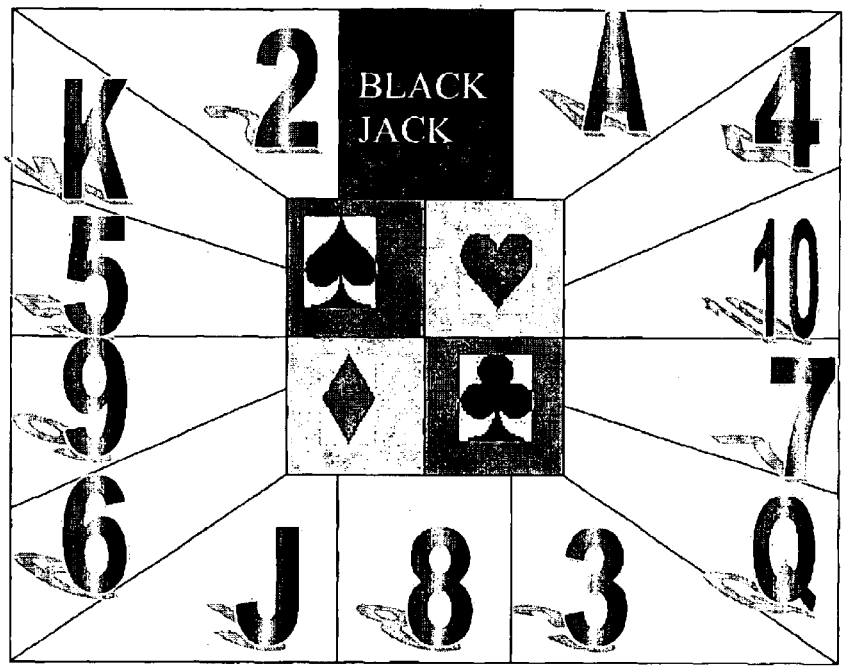
Figure 6D:
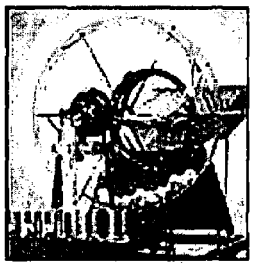

With reference to FIGS. 6A–6D, various mechanically-controlled random card selection mechanisms are illustrated for one or more spinning wheels, one or more rings of chase lights, or air-driven balls in a spinning drum. As discussed above, the second visual display region may be provided either as video, which may include a video display unit or a high-resolution liquid crystal display (LCD), or the selection may be mechanically-controlled for the reasons discussed above. In FIG. 6A, randomness is achieved by spinning reels similar to that of slot machines, implemented herein for card games, e.g., blackjack. One reel may be used to contain all 52 card values; on the other hand, two reels may also be employed, e.g., the four suits and the other wheel for 13 card values. When using one or more spinning wheels as illustrated in FIG. 6B, a window is provided through which the card value is determined by the combination of the wheels. A multiplicity of different wheel arrangements may be configured with wheels either showing the same axis or being shown side by side or the like. Again, implementation may include a single wheel for all 52 card values or two or more wheels divided, e.g., between value and card suit. FIG. 6C provides one or more rings of chase lights, which are combined to show either the 52 card values or a combination of multiple rings, e.g., an inner ring containing the four suits and an outer ring containing the 13 card values. In FIG. 6D, a mechanical, air-driven spinning drum is employed with balls much as those employed in lottery-type drawing machines with randomness achieved by the force of compressed air and the spinning drum. An implementation for card games, e.g., blackjack, may employ 52 balls to represent each of the 52 card values.

While the present invention has been illustrated by a description of various embodiments and while these embodiments have been set forth in considerable detail, it is intended that the scope of the invention be defined by the appended claims. It will be appreciated by those skilled in the art that modifications to the foregoing preferred embodiments may be made in various aspects. It is deemed that the spirit and scope of the invention encompass such variations to the preferred embodiments as would be apparent to one of ordinary skill in the art and familiar with the teachings of the present application.

What is claimed is:

1. A card game machine comprising:

a first visual display region for displaying a plurality of cards;

a second visual display region for displaying card value and suit;

means for generating an initial card display in the first visual display region to initiate a card game;

a player control for effecting card play in the second visual display region;

means responsive to the player control for user selection input for generating card value and suit for display in the second visual display region, the second region separately identifying the display of card value and separately identifying the display of card suit with the user selection input; and means responsive to the generation of the card value and suit displayed in the second visual display region for displaying the card value and suit in the first visual display region.

2. A card game machine as recited in claim 1 wherein the means for generating card value and suit is controlled by a microprocessor.

3. A card game machine as recited in claim 2 wherein the second visual display region comprises a video reel.

4. A card game machine as recited in claim 1 wherein the second visual display region comprises a first reel for displaying card value and a second reel for displaying card suit.

5. A card game machine as recited in claim 4 wherein the second visual display region comprises at least one rotatable reel.

6. A card game machine as recited in claim 1 wherein the means for generating card value and suit is mechanical.

7. A card game machine as recited in claim 1 wherein the means for generating an initial card display in the first visual display region is responsive to the generation of card value and suit in the second visual display region.

8. A method for playing a card game controlled by a processor, the method comprising:

providing a first region with a visual display on a card game machine for displaying a plurality of cards;

providing a second region with a visual display on the card game machine for presenting a card selection display of card value and suit indicia;

operating a game program with the processor for drawing cards appearing on the first region;

receiving card selection input in relation to the second region for display on the first region of the visual display; and providing a player control interface for user selection input to the card game machine effecting the selection of cards at the second region, the second region separately identifying the display of card value and separately identifying the display of card suite with the user selection input.

9. A method as recited in claim 8, wherein the provided player control interface comprises a button controller switch or touchscreen for effecting the selection of cards at the second region.

10. A method as recited in claim 8, comprising providing a video display of the plurality of cards in the first region and at least one rotatable wheel display at the second region.

11. A method as recited in claim 10, wherein the at least one rotatable wheel is presented on a second video display.

12. A method as recited in claim 8 wherein the card value and suit generated for display in the second region controls card play of a player's hand in the first region.

13. A method as recited in claim 12, wherein the card value and suit are generated for display in the second region for the card play of multiple player hands in the first region.

14. A method as recited in claim 8, comprising providing a first video display for displaying the first region displaying the plurality of cards, and further providing a second video display for displaying the second region displaying the card selection value and suit indicia.

15. A method as recited in claim 14, wherein the second video display displays at least one rotatable wheel.

16. A method as recited in claim 14, wherein the second video display displays a series of images relating to individual playing cards.

17. A card game machine comprising:

a visual display on the card game machine for displaying a first region for displaying a plurality of cards;

said visual display providing a second region on the card game machine for presenting a card selection display of card value and suit indicia;

a processor for operating a card game program for drawing cards appearing on the first region;

a processor interface responsive to the card game program for receiving card selection input in relation to the second region for display on the first region of the visual display; and a user interface for providing a player control for user selection input to the card game machine effecting the selection of cards at the second region, the second region separately identifying the display of card value and separately identifying the display of card suit with the user selection input.

18. A card game machine as recited in claim 17, wherein the visual display is presented on a video display of the plurality of cards in the first region and at least one rotatable wheel display at the second region.

19. A card game machine as recited in claim 18, wherein the at least one rotatable wheel is presented on a second video display.

20. A card game machine as recited in claim 17 wherein the card value and suit generated for display in the second region controls card play of a player's hand and a dealer's hand in the first region.

21. A card game machine as recited in claim 17, wherein the visual display provides a first video display for displaying the first region displaying the plurality of cards, and further provides a second video display for displaying the region displaying the card selection value and suit indicia.

* * * * *